US006501917B1

(12) United States Patent
Karasawa

(10) Patent No.: US 6,501,917 B1
(45) Date of Patent: Dec. 31, 2002

(54) METHOD AND APPARATUS FOR IMAGE FORMING CAPABLE OF EFFECTIVELY PERFORMING IMAGE DENSITY ADJUSTMENT

(75) Inventor: Kazunori Karasawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 84 days.

(21) Appl. No.: 09/703,934

(22) Filed: Nov. 2, 2000

(30) Foreign Application Priority Data

Nov. 2, 1999 (JP) ..... 11-312145

(51) Int. Cl.[7] ..... G03G 15/00

(52) U.S. Cl. ..... 399/46; 399/49; 399/50; 399/51

(58) Field of Search ..... 399/46, 49, 50, 399/51

(56) References Cited

U.S. PATENT DOCUMENTS 5,461,462 A 10/1995 Nakane et al.
5,619,316 A 4/1997 Shoji et al.

FOREIGN PATENT DOCUMENTS

JP 6-110285 * 4/1994
JP 6-208271 7/1994
JP 7-248659 9/1995
JP 8-202092 8/1996
JP 8-265570 10/1996
JP 8-297384 11/1996
JP 8-297834 11/1996
JP 11-119477 4/1999

* cited by examiner

*Primary Examiner*—Hoang Ngo
(74) *Attorney, Agent, or Firm*—Oblon, Spivak, McClelland, Maier & Neustadt, P.C.

(57) ABSTRACT

An image forming apparatus including a photoconductive member, a charging mechanism, an optical writing mechanism, a development mechanism, a sensing mechanism, and a controlling mechanism. The charging mechanism charges a surface of the photoconductive member at a charge voltage. The optical writing mechanism writes latent images including first and second latent images on the surface of the photoconductive member. The development mechanism develops the first latent image into a first toner pattern at a solid toner density and the second latent image into a second toner pattern at a half-tone tone density. The sensing mechanism detects reflection densities of the first and second toner patterns and generates output signals representing detection results detected by the sensing mechanism. The controlling mechanism adjusts values of the solid toner density, the charge voltage, and the half-tone toner density based on the output signals. The controlling mechanism adjusts the value of the charge voltage by changing a voltage to be applied to the charging mechanism at intervals of a predetermined time period and adjusts the value of the half-tone toner density by controlling the optical writing mechanism to change a light amount.

19 Claims, 4 Drawing Sheets

METHOD AND APPARATUS FOR IMAGE FORMING CAPABLE OF EFFECTIVELY PERFORMING IMAGE DENSITY ADJUSTMENT

CROSS-REFERENCE TO RELATED APPLICATIONS

This application claims priority to Japanese patent application No. JPAP11-312145 filed on Nov. 2, 1999 in the Japanese Patent Office, the entire contents of which are hereby incorporated by reference.

BACKGROUND OF THE INVENTION

1. Field of the Invention

The present invention relates to a method and apparatus for image forming, and more particularly to a method and apparatus for image forming that is capable of effectively performing an image density adjustment.

2. Discussion of the Background

In order to maintain high image quality using image forming apparatuses such as digital copying machines, printers, and facsimile machines which form an image on a photoconductive member with a laser beam, stabilizing a half-tone image density has been considered a major factor. One example of an image forming apparatus which attempts to stabilize the half-tone image density is described in Japanese Laid-Open Patent Publication No. 6-208271. This image forming apparatus has a configuration whereby several calculations are performed. A control voltage which controls a charging mechanism for charging a photoconductive member at a desired dark voltage is calculated. An amount of a laser beam for obtaining a desired half-tone image voltage is calculated based on a voltage of a latent image patch which is formed on the photoconductive member charged at the desired dark voltage and a light amount for producing the latent image patch. A development bias voltage is calculated by subtracting the desired dark voltage by a predetermined voltage. Based on these calculations, the control voltage, the amount of the laser beam, and the development bias voltage are updated. However, this technique requires voltage detection. Since voltage detection equipment normally is an expensive tool, the manufacturing cost of the image forming apparatus is increased.

Another example of an image forming apparatus which attempts to stabilize the halftone image density is described in Japanese Laid-Open Patent Publication No. 8-265570. This image forming apparatus includes a toner pattern generating mechanism for generating a toner image density detection pattern on an image bearing member, an image density detection mechanism for detecting an image density of a toner image, a controlling mechanism for controlling the image density in accordance with the detection result, and a data table for representing a gray-scale based on a relationship between the detection result and the image density. However, this technique requires a relatively long time period to perform the detection of a half-tone image since it generates a number of half-tone image patterns during the time of such detection. Moreover, since this technique conducts the adjustment of the half-tone image density during a time period of a power wide modulation of a laser diode, the accuracy with respect to a width of the adjustment is relatively rough.

Another example of an image forming apparatus which attempts to control an amount of toner deposition in a range of images from a solid black image to a half-tone image is described in Japanese Laid-Open Patent Publication No. 8-297834. This image forming apparatus includes a test patch generating mechanism for generating test patches for solid black and half-tone images using toner on an image carrying member and an image density detection mechanism for detecting image density of the test patches. With such a configuration, the image forming apparatus controls a density of a solid black image by controlling a rotation speed of the image carrying member based on the detection result with respect to the solid black image. Then, detection of image density with respect to the test patch of the half-tone image is performed and, based on the detection result, the density of the half-tone image is controlled by control of a laser power. However, controlling the rotation speed of the image bearing member requires an expensive mechanism which increases the manufacturing cost of the image forming apparatus. Moreover, this configuration may cause an overlapping of a background image or an erroneous white mark in a rear edge of a half-tone image by changing the rotation speed of the image carrying member, particularly, in a case that the image forming apparatus uses a development agent of two components and a magnetic brush. In addition, the above-mentioned three image forming apparatuses commonly use a scorotron charger, that is, a corona charger having a screen electrode and which is prone to produce ozone.

A contact type charger such as a charging roller is known to produce less ozone but also to cause variations of charge voltage to a relatively great extent. The variations of the charge voltage can be reduced with a technique which corrects a charge output using a sensor for detecting a reflection density. However, this technique also has a drawback in that the difference between the charge voltages before and after the adjustment adversely affects a voltage of the half-tone image and, as a result, the image density of the half-tone image is varied.

SUMMARY OF THE INVENTION

Accordingly, an object of the invention is to provide a novel image forming apparatus. The novel image forming apparatus includes a photoconductive member, a charging mechanism, an optical writing mechanism, a development mechanism, a sensing mechanism, and a controlling mechanism. The charging mechanism is configured to charge a surface of the photoconductive member in order that the surface is charged at a charge voltage. The optical writing mechanism is configured to write latent images including a first latent image and a second latent image on the surface of the photoconductive member charged at the charge voltage. The development mechanism is configured to develop the first latent image into a first toner pattern at a solid toner density and the second latent image into a second toner pattern at a half-tone tone density. The sensing mechanism is configured to detect reflection densities of the first and second toner patterns and to generate output signals representing detection results detected by the sensing mechanism. The controlling mechanism is configured to adjust values of the solid toner density, the charge voltage, and the half-tone toner density based on the output signals generated by the sensing mechanism. In the above-mentioned novel image forming apparatus, the controlling mechanism adjusts the value of the charge voltage by changing a voltage to be applied to the charging mechanism at intervals of a predetermined time period and adjusts the value of the half-tone toner density by controlling the optical writing mechanism to change a light amount.

The charging mechanism may include a charging roller configured to apply a charge to the photoconductive member in contact thereto.

The optical writing mechanism may write a third latent image on the surface of the photoconductive member charged at the charge voltage and the development mechanism may develop the third latent image into a third toner pattern at a solid toner density so that the first toner pattern is used to adjust the value of the solid toner density and the third toner pattern is used to adjust a value of the charge voltage.

The controlling mechanism is configured to adjust the value of the half-tone toner density based on the output signals generated by the sensing mechanism upon completing the adjustment of the solid toner density and the charge voltage based on the output signals generated by the sensing mechanism after the completion of a job.

The controlling mechanism is configured to adjust the value of the half-tone toner density by controlling the optical writing mechanism to change the light amount at multiple levels so that the apparatus forms a multi-level half-tone image.

The image forming apparatus is configured to form the multi-level half-tone image using an error diffusion.

The present invention further provides a novel method for image density adjustment. The novel method of image density adjustment includes the steps of charging, optically writing, developing, detecting, generating, and adjusting. The charging step charges a surface of a photoconductive member so that the surface is charged at a charge voltage. The optically writing step writes latent images including a first latent image and a second latent image on the surface of the photoconductive member charged at the charge voltage. The developing step develops the first latent image into a first toner pattern at a solid toner density and the second latent image into a second toner pattern at a half-tone tone density. The detecting step detects reflection densities of the first and second toner patterns. The generating step generates output signals representing results of the detecting step. The adjusting step adjusts values of the solid toner density, the charge voltage, and the half-tone toner density based on the output signals generated by the generating step. In the above described novel method, the adjusting step adjusts the value of the charge voltage by changing a voltage to be applied in the charging step at intervals of a predetermined time period and the value of the half-tone toner density by controlling the optically writing step to change a light amount.

The charging step may use a charging roller configured to apply a charge to the photoconductive member in contact thereto.

The optically writing step may write a third latent image on the surface of the photoconductive member charged at the charge voltage and the development step may develop the third latent image into a third toner pattern at a solid toner density so that the first toner pattern is used to adjust the value of the solid toner density and the third toner pattern is used to adjust value of the charge voltage.

The adjusting step may adjust the value of the half-tone toner density based on the output signals generated in the generating step upon completing the adjustment of the solid toner density and the charge voltage based on the output signals generated in the generating step after the completion of a job.

The adjusting step may adjust the value of the half-tone toner density by controlling the optically writing step to change the light amount at multiple levels so that the method is applied to a multi-level half-tone image.

The method for image density adjustment may be applied to the multi-level half-tone image using an error diffusion.

BRIEF DESCRIPTION OF THE DRAWINGS

A more complete appreciation of the present application and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
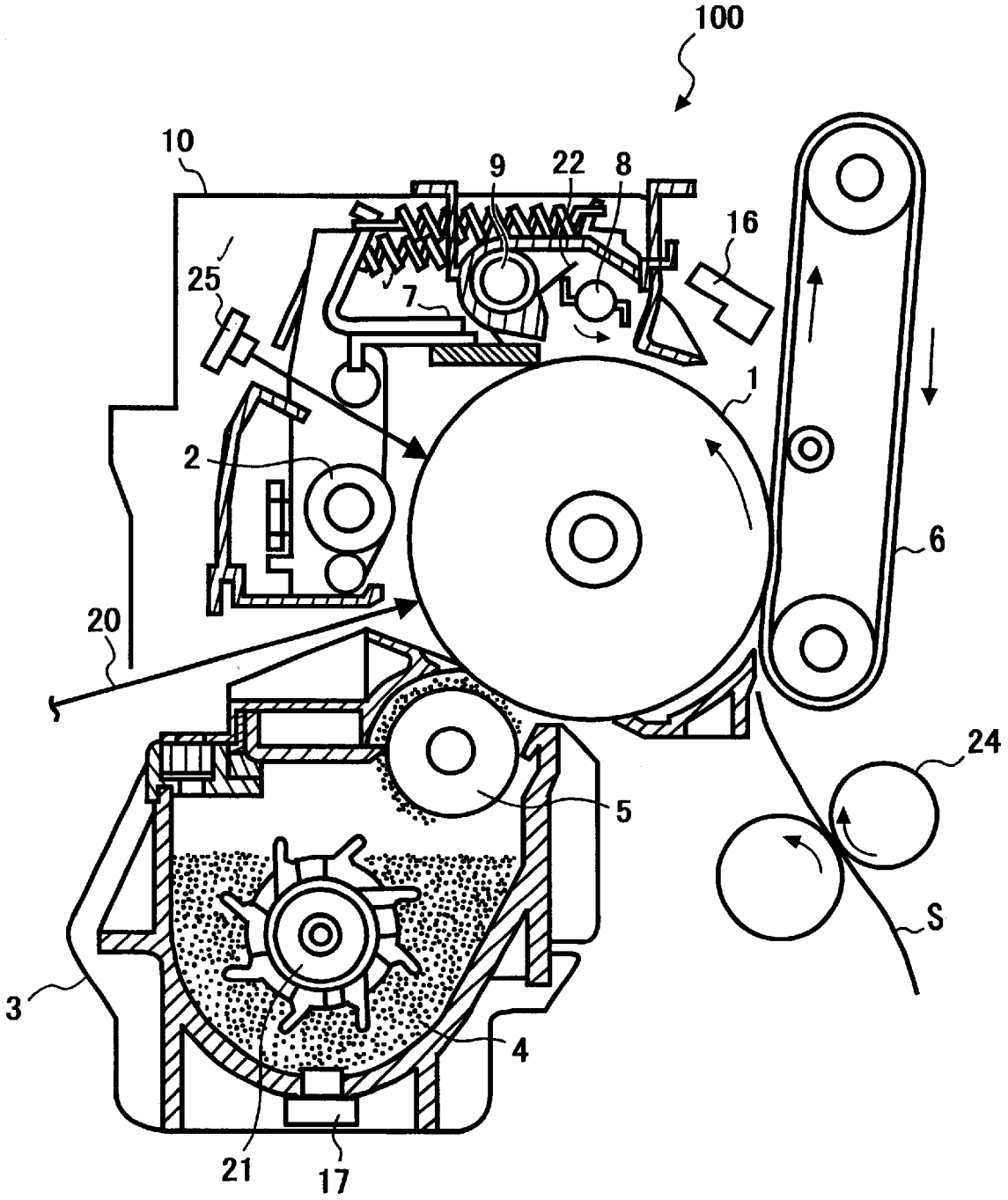
FIG. 1 is a schematic illustration of an image forming apparatus according to an embodiment of the present invention.

In describing the embodiments of the invention illustrated in the drawings, specific terminology is employed for the sake of clarity. However, the invention is not intended to be limited to the specific terminology so selected and it is to be understood that each specific element includes all technical equivalents which operate in a similar manner.

Referring now to the drawings, wherein like reference numerals designate identical or corresponding parts throughout the several views, particularly to FIG. 1, an image forming apparatus 100 according to an embodiment of the present invention is explained. FIG. 1 shows a main portion of the image forming apparatus 100 which can be used as a digital copying machine, a printer, a facsimile machine, or the like. The main portion of the image forming apparatus 100 shown in FIG. 1 includes a photoconductive member 1, a development unit 3, a transfer belt 6, a cleaning unit 10, and a pair of registration rollers 24. The cleaning unit 10 includes a main-charge roller 2 and a discharging member 25.

As shown in FIG. 1, the main-charge roller 2 contacts the surface of the drum-shaped photoconductive member 1 so as to be rotated by the photoconductive member 1 rotating in a direction indicated by the arrow. During the image forming operation, the photoconductive member 1 rotating in the direction of the arrow is first discharged by the discharging member 25 and is then evenly charged by the main-charge roller 2. A brush type charger configured to contact the photoconductive member 1 may be used in place of the main-charge roller 2.

The charged photoconductive member 1 is exposed to a laser bean 20 which is modulated with an image signal including image information so that an electrostatic latent image is formed on the surface of the photoconductive member 1. In a reverse development technique, the electrostatic latent image formed on the photoconductive member 1 is made visible with toner particles attracted thereto during a time when the electrostatic latent image is moved to pass by the development unit 3. The development unit 3 contains in a case a development agent 4 including toner and carriers. The toner is non-magnetic and the carriers are magnetic particles. The development unit 3 is provided in the case with a development sleeve 5 and a paddle roller 21. The development sleeve 5 is positioned close to the photoconductive member 1 and is rotated. The paddle roller 21 is configured to supply the toner to the development sleeve 5.

The development agent 4 is agitated by the rotation of the paddle roller 21 and the toner is charged with a friction charge caused by the agitation of the paddle roller 21. The development sleeve 5 includes a fixed magnetic bar and a perimetric region which includes a non-magnetic member and is rotated around the fixed magnetic bar. The development roller 5 is supplied with the development agent 4 including the charged toner by the paddle roller 21 so that the development agent 4 is deposited on the development sleeve 5 in a shape of a brush. When a brush of the development agent 4 contacts the photoconductive member 1, the toner is attracted to the electrostatic latent image and is deposited on the photoconductive member 1 by the electrostatic force. Thereby, the electrostatic latent image is transferred into a toner image. The amount of toner used in forming the toner image is determined by a difference between a voltage of the electrostatic latent image on the photoconductive member 1 and a bias voltage applied to the development roller 2. In addition, the voltage of the electrostatic latent image is determined by an initial charge voltage given by the main-charge roller 2 and an intensity of the laser beam 20.

The toner image formed on the photoconductive member 1 is rotated as the photoconductive member 1 is rotated and is brought to a transfer region where the transfer belt 6 contacts the photoconductive member 1. The transfer belt 6 is positioned in contact with the photoconductive member 1 and is rotated at a linear speed which is the same as the linear speed of the photoconductive member 1 in the direction which is the same as the direction of the photoconductive member 1 at the contact region. The transfer belt 6 is supplied with a transfer bias having a polarity reverse to the polarity of toner by a power source (not shown).

The transfer belt 6 disconnects from the photoconductive member 1 each time a job is completed, wherein a job includes processes in one cycle of the image forming including the charging of the photoconductive member 1, the exposure, and the image transfer. At power-on time, for example, each component performs a preparatory operation such as a running-in operation. After a time when the main-charge roller 2, the development unit 3, and so on are activated and when the laser beam 20 is generated, the image forming apparatus 100 forms, as described later, predetermined test patterns including a toner density adjustment pattern and a charge voltage adjustment pattern. In this case, however, if the transfer belt 6 is always in contact with the photoconductive member 1, then the above-mentioned test patterns will be transferred to the transfer belt 6. That is, the image forming apparatus 100 cannot perform adjustments of a toner density and a charge voltage using the test patterns formed on the photoconductive member 1. Therefore, the transfer belt 6 is moved away from the photoconductive member 1 during the above described running-in operations at power-on time and at the completion of each job and is again placed in contact with the photoconductive member 1 in time for the start of the next job.

As an alternative to the transfer belt 6, the image forming apparatus 100 may employ a transfer mechanism using a transfer charger configured to be operable at a distance from the photoconductive member 1. With reference to FIG. 1, the registration rollers 24 start to send a transfer sheet S into the image forming mechanism so that the toner image on the photoconductive member 1 which is proximate to the transfer mechanism is transferred at an appropriate position on the transfer sheet S. During the transfer process, an electric field is generated between the transfer belt 6 and the photoconductive member 1 which causes the toner image to move from the photoconductive member 1 to the transfer sheet S which is conveyed at the same linear speed as the linear speed of the photoconductive member 1. Thus, the toner image is transferred onto the transfer sheet S.

After the transfer operation, the transfer sheet S is further pushed forward by the transfer belt 6 and is brought into a fixing unit (not shown) which is located downstream from the transfer belt 6. The fixing unit fixes the toner image onto the transfer sheet S by heat.

Toner which is not used for the toner image and remains on the photoconductive member 1 is conveyed downstream by the rotation of the photoconductive member 1 and is brought to the cleaning unit 10. In the cleaning unit 10, the residual toner is stopped and held by a cleaning blade 7 of the cleaning unit 10. The residual toner held by the cleaning blade 7 is transferred into a collection coil 9 by the cooperative actions of a collection wing 8 rotating counterclockwise and a plastic plate 22 (e.g. a Mylar). The collection coil 9 includes a screw conveyer using a wire wound in a spiral fashion and conveys the toner by the rotation of the spiral wire.

In the cleaning unit 10, the collection coil 9 is sealed by a case except for a portion from where the toner is input. After the cleaning unit 10, the collection coil 9 is protected by a collection tube (not shown) provided for a length between the cleaning unit 10 and the development unit 3 so that the collection coil 9 can securely convey the collected toner from the cleaning unit 10 to the development unit 3. Inside the development unit 3, the collection coil 9 drops the conveyed toner on the paddle roller 21. According to this embodiment, the toner remaining on the photoconductive member 1 can be returned to the development unit 3 by the collection coil 9 in order to be recycled.

Figure 2:
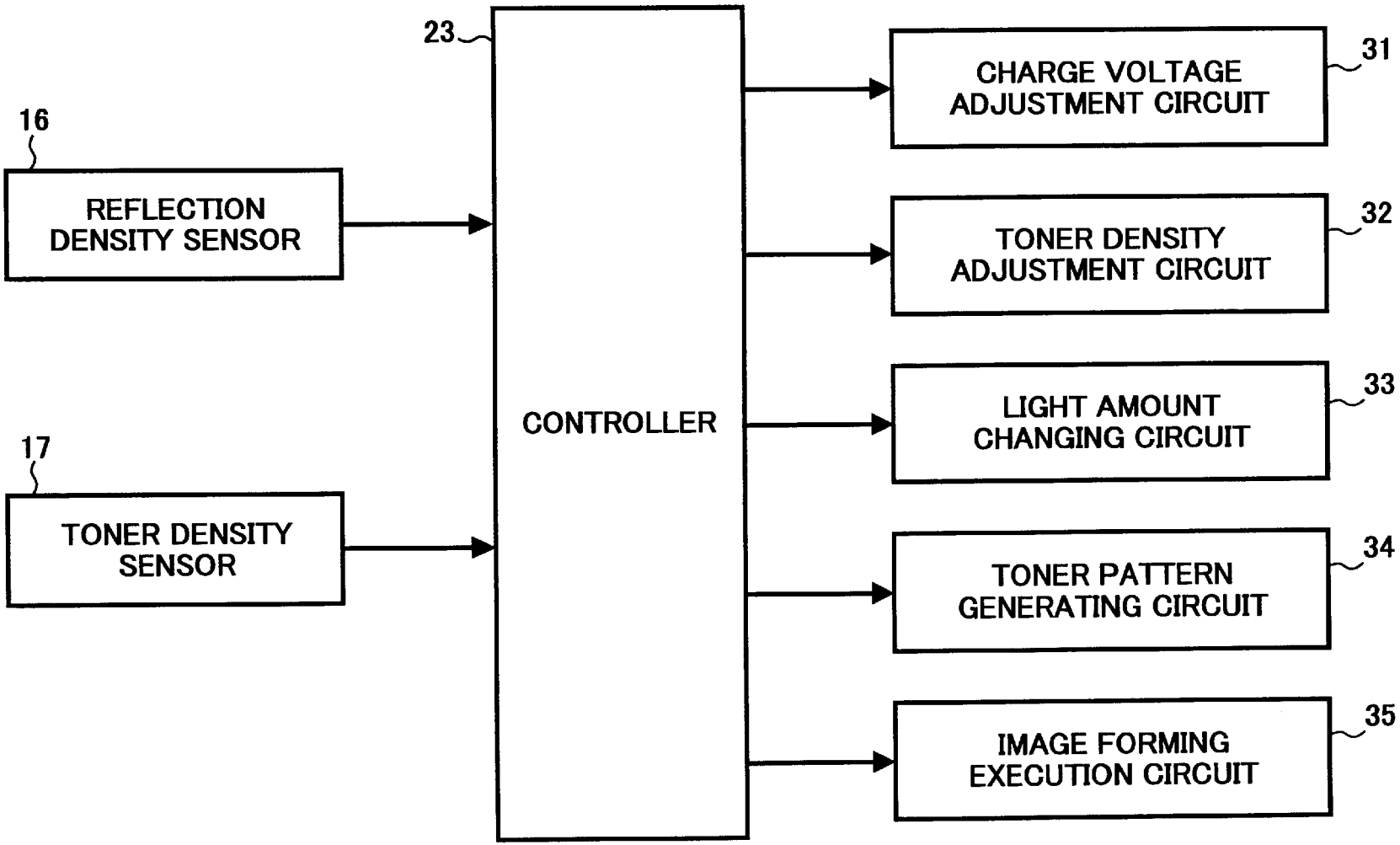
FIG. 2 is a block diagram of an image density control mechanism of the image forming apparatus of FIG. 1.
Figure 3A:
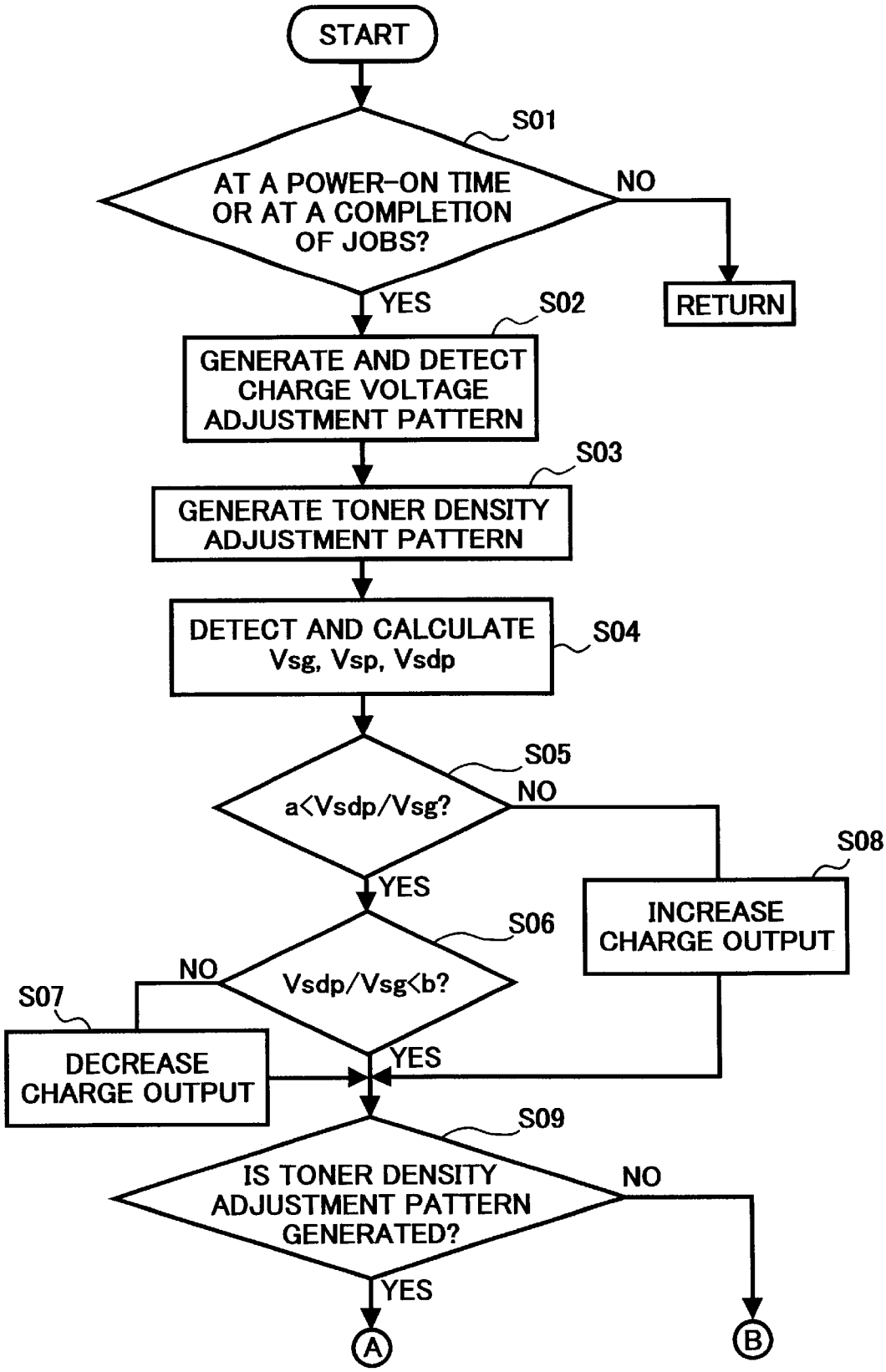
FIGS. 3A and 3B are flowcharts showing an exemplary procedure of a half-tone density adjustment operation performed by the image forming apparatus of FIG. 1.
Figure 3B:
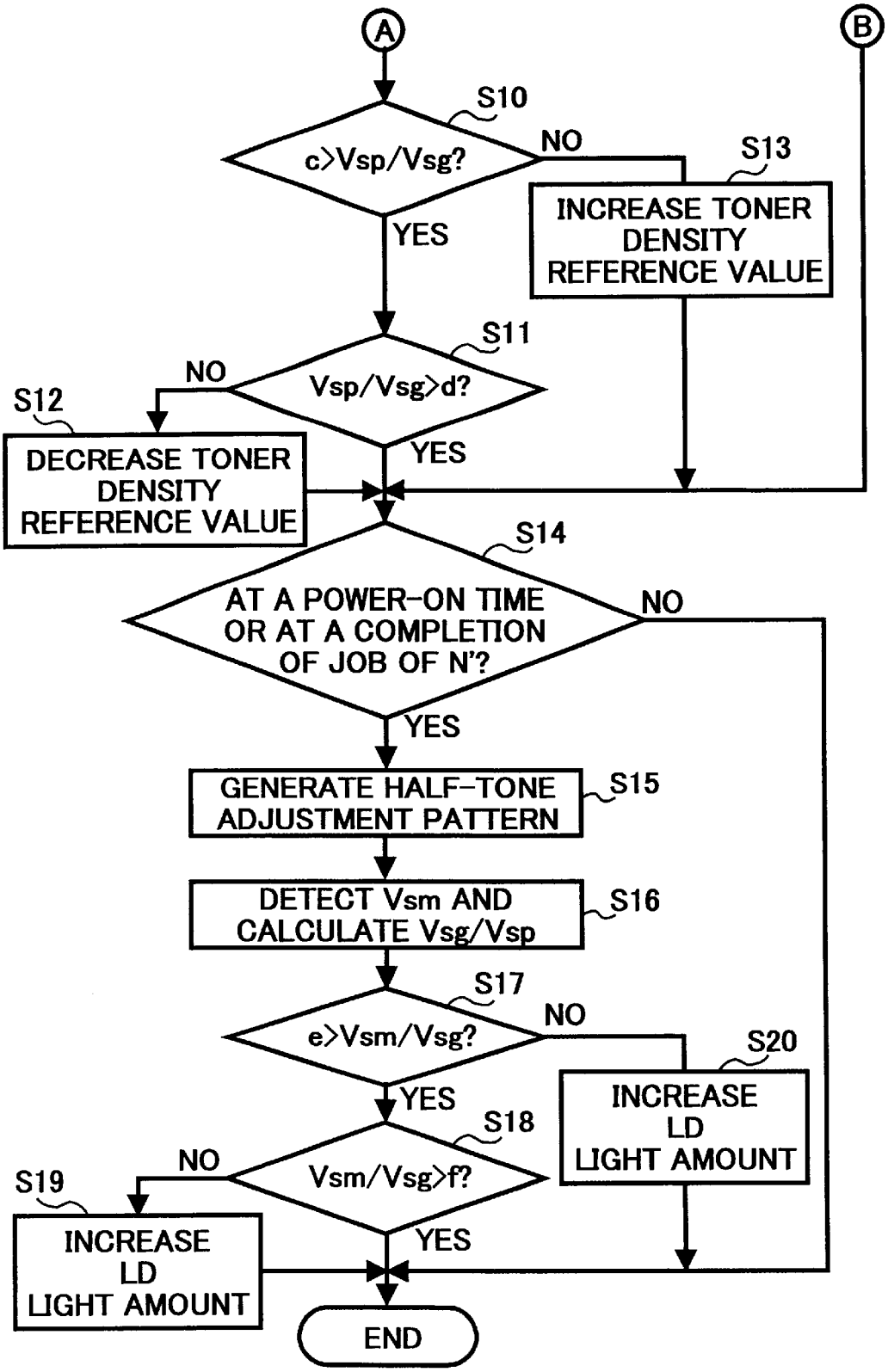

Next, with reference to FIGS. 2, 3A, and 3B, an adjustment of the image density of the image formed on the photoconductive member 1 is described. FIG. 2 is a block diagram of an image density control mechanism of the image forming apparatus 100 of FIG. 1. As shown in FIG. 2, the image density control mechanism includes a reflection density sensor 16, a toner density sensor 17, a controller 23, a charge voltage adjustment circuit 31, a toner density adjustment circuit 32, a light amount changing circuit 33, a toner pattern generating circuit 34, and an image forming execution circuit 35. Locations of the two sensors 16 and 17 are shown in FIG. 1, and their functions are described later. The controller 23 controls the entire operation of the image density adjustment operation. The charge voltage adjustment circuit 31 adjusts a charge voltage in accordance with instructions from the controller 23. The toner density adjustment circuit 32 adjusts a toner density in accordance with instructions from the controller 23. The light amount changing circuit 33 executes a light amount changing operation in accordance with instructions from the controller 23. The toner pattern generating circuit 34 generates various patterns of toner images in accordance with instructions from the controller 23. The image forming execution circuit 35 executes the image forming operation in accordance with instructions from the controller 23.

If the light intensity of the laser beam 20 is kept constant, the image density of the image formed on the photoconductive member 1 is kept constant under the conditions that the charge voltage of the photoconductive member 1 charged by the main-charge roller 2 is kept constant and that the density of the development agent is kept constant. However, the image density of the image is varied by several events. For example, the image density is varied by the deterioration over time of the photoconductive member 1 or by relatively great variations of the charge voltage in which the main-charge roller 2 is prone to show as a characteristic. Thus, in order to maintain the image density at a predetermined constant level two adjustments are conducted. In a first adjustment, a toner pattern having a solid black image is formed on the photoconductive member 1 and the charge voltage of the main-charge roller 2 is adjusted so that the image density of the solid black image in the toner pattern is at a predetermined reference level. In a second adjustment, a mixture ratio of the toner and the carrier in the development agent 4 is adjusted to be at a predetermined reference level.

Test patterns are formed on the photoconductive member 1 for the purposes of the above-mentioned first and second adjustments, and these test patterns are detected by the reflection density detection sensor 16 (hereinafter, referred to as P sensor 16). The P sensor 16 is located at a position around the perimeter of the photoconductive member 1 and between the transfer belt 6 and the cleaning blade 7, as shown in FIG. 1.

As shown in FIG. 2, the signal output from the P sensor 16 is input to a controller 23 for controlling the entire image forming operation of the image forming apparatus 100. For the second adjustment, the toner density sensor 17 (hereinafter, referred to as T sensor 17) for detecting the toner density is provided inside the development unit 3, as shown in FIG. 1. A signal output from the T sensor 17 is also input to the controller 23.

The controller 23 compares the output from the T sensor 17 with a predetermined reference density value and determines if the output from the T sensor 17 is lower than the predetermined reference density value. If the output from the T sensor 17 is determined to be lower than the predetermined reference density value, the controller 23 instructs the development unit 3 to increase the amount of toner to be supplied so that the level of the image density becomes approximately equal to the predetermined reference density value. But, if the output from the T sensor 17 is higher than the predetermined reference density value, the controller 23 instructs the development unit 3 to decrease the amount of toner to be supplied so that the level of the image density becomes approximately equal to the predetermined reference density value.

The P sensor 16 is not activated as the detector for the pattern of the toner density adjustment at power-on time, but is activated each time when a job defined by a certain amount, or number, of image forming is executed. This may be determined by counting a number of the output transfer sheets S, for example. Since the controller 23 of FIG. 2 controls the entire image forming operation, it keeps track of each process of the image forming operation and the job being achieved. Therefore, when the controller 23 determines that the P sensor 16 is activated, an optical writing operation is executed in accordance with the program of the controller 23. In the optical writing operation, the photoconductive member 1 is exposed to the laser beam 20 output from a laser diode (not shown) so that a pattern for the toner density adjustment including a solid black image in a predetermined size is formed on the photoconductive member 1.

The toner density adjustment pattern is then developed by the development unit 3. The transfer belt 6 is kept away from the photoconductive member 1 so as not to remove the toner density adjustment pattern from the photoconductive member 1. Thus, the toner density adjustment pattern can pass by the transfer region and then by the P sensor 16, without being removed by the transfer belt 6. The P sensor 16 detects a reflection density of the toner density adjustment pattern and sends an output signal to the controller 23. The controller 23 compares the output value output from the P sensor 16 with the predetermined reference toner density value to determine which value is lower. If the output value output from the P sensor 16 is determined to be lower than the predetermined reference toner density value, the reference value set for the T sensor 17 is increased so that the amount of toner to be supplied is increased to a desired level. As a result, the toner density is increased to a desired level.

If the output value output from the P sensor 16 is determined to be higher than the predetermined reference toner density value, the reference value set for the T sensor 17 is decreased so that the amount of toner to be supplied is decreased to a desired level. As a result, the toner density is decreased to a desired level. In this way, the density of the solid black in the toner density adjustment pattern is adjusted to the predetermined reference level and, as a result, the density of the solid black in an output image can be assured to be at a constant level.

An increase or decrease of the reference value for the T sensor 17 is determined with reference to a lookup table having a plurality of experimentally obtained values on the basis of the output value of the P sensor 16. Accordingly, the controller 23 performs the toner density control operation to make the solid black density stable.

The following is a description of an adjustment procedure with respect to the charge voltage output from the main-charge roller 2 based on the output signal from the P sensor 16. A pattern for use in the charge voltage adjustment is formed, in a manner similar to that of the toner density adjustment pattern, on the photoconductive member 1 at a position displaced from the position at which the toner density adjustment pattern is formed. The charge voltage adjustment pattern is formed. That is, the charge voltage adjustment operation is performed at each power-on time as well as at each time that a job defined by when a predetermined amount, or a predetermined number, of image forming is completed (i.e., a predetermined number of sheets are printed). The toner density adjustment pattern is formed each time that a job defined by a predetermined amount, or a predetermined number, of image forming is completed. The reason for this is because, in an image forming apparatus (e.g., the image forming apparatus 100) employing a charging mechanism using the roller type charger (e.g., the main-charge roller 2), the charge voltage varies to a relatively great extent. Thus, the charge voltage needs to be adjusted at each power-on time.

In the image forming apparatus 100, the charge voltage adjustment pattern is formed and is detected by the P sensor 16. When the charge voltage adjustment pattern is formed, the voltage applied to the main-charge roller 2 is switched to a value so that the main-charge roller 2 outputs a predetermined charge output. The photoconductive member 1 is charged with this predetermined charge output by the main-charge roller 2 and is then exposed to the laser beam 20 which includes data of the charge voltage adjustment pattern such that an electrostatic latent image is formed in accordance with the charge voltage adjustment pattern on the photoconductive member 1. By developing the formed electrostatic latent image in this manner, a black solid toner pattern for the charge voltage adjustment is prepared. The charge voltage adjustment pattern is conveyed by the rotation of the photoconductive member 1 to pass by the P sensor 16 without being transferred to the transfer belt 6. The pattern is not transferred because the transfer belt 6 is moved away from the photoconductive member 1 during the charge voltage adjustment as is so in the case of the toner density adjustment. Then, the P sensor 16 detects the charge voltage adjustment pattern and sends an output signal to the controller 23 which compares it with a predetermined reference value. As a comparison result, if the value of the output signal is determined to be higher than the predetermined reference value, the controller 23 determines that the voltage value applied to the main-charge roller 2 is low, that is, the charge output of the main-charge roller 2 is low. Accordingly, the controller 23 controls the voltage value applied to the main-charge roller 2 in order to raise the charge output thereof. But, if the value of the output signal is determined as being lower than the predetermined reference value, then the controller 23 determines that the voltage value applied to the main-charge roller 2 is high, that is, the charge output of the main-charge roller 2 is high. In this case, the controller 23 controls the voltage value applied to the main-charge roller 2 in order to reduce the charge output thereof.

In this way, the image forming apparatus 100 generates and evaluates the charge voltage adjustment pattern at power-on time and the charge voltage adjustment pattern and the toner density adjustment pattern each time that a job defined by a predetermined amount, or a predetermined number, of image forming is completed. In addition, the image forming apparatus 100 performs the appropriate correction operations in accordance with the evaluation results in the various manners described above.

The photoconductive member 1 is configured to perform a run-in operation for a predetermined time period at power-on time. The above described evaluation and correction operations at power-on time are performed during such a run-in operation of the photoconductive member 1. However, if the charge voltage of the solid black image is used as a base for determining a charge voltage applied to a latent image of half-tone, the above described adjustment of the charge voltage for the solid black image would also cause a change of the charge voltage for the latent image of half-tone. As a result, a voltage of the latent image of half-tone would be changed and, in some cases, the image density of such half-tone image would be outside of the allowable level.

However, the controller 23 controls the adjustment of the image density for the halftone image upon adjustment of the voltage to the main-charge roller 2 in order that the above-mentioned problem is avoided. For this purpose, the controller 23 generates a test pattern for the half-tone density adjustment. Using this half-tone density adjustment pattern, the controller 23 performs a half-tone density adjustment in a manner similar to that in the adjustment of the charge voltage adjustment for the solid black density. That is, the P sensor 16 detects a reflection density from the half-tone density adjustment pattern and, if a detection output is outside of a predetermined output limit, the light amount for the image writing is changed so that the half-tone density is corrected.

In order to write an image on the photoconductive member 1, a laser diode (LD) is used in this embodiment and the controller 23 controls an emission of the LD in order to adjust the light amount for the half-tone image writing. Thereby, the density of the half-tone image is maintained at a constant level. In addition, the controller 23 conducts the half-tone density adjustment at frequent intervals, such as, for example, each time subsequent to the output of a predetermined number of the transfer sheets S. The number of transfer sheets may be determined through experimentation. This embodiment is configured in such a manner because the voltage of the latent image of half-tone is prone to be varied by a deterioration of the photoconductive member 1 over time.

Next, an exemplary procedure of the half-tone density adjustment is explained in detail with reference to FIGS. 3A and 3B. FIGS. 3A and 3B together show an exemplary procedure of the half-tone density adjustment performed by the image forming apparatus 100. In Step S01 of FIG. 3A, the controller 23 of the image forming apparatus 100 determines whether the image forming apparatus 100 is in a running-in process at power-on time or whether it has completed at least a job defined by a predetermined amount, or a predetermined number, of image forming. As described above, the transfer belt 6 is configured to be in contact with the photoconductive member 1 during the time of the job, but is separated from the photoconductive member 1 after the job so that each of the charge voltage adjustment and toner density adjustment patterns remains held on the photoconductive member 1 during the running-in operations. Therefore, in Step S01, the "completion of the job" is added as a condition. But, in a case where a transfer charger is used in place of the transfer belt 6, the "completion of the job" is not necessarily added as a condition because the transfer charger is normally operative at a position distant from the photoconductive member 1.

The reason for adding the "predetermined amount, or predetermined number, of image forming" as another condition is because it is preferred to perform the charge voltage and toner density adjustments at intervals in which the toner density and the charge voltage may be varied with time. With regard to the image forming apparatus 100, the "predetermined amount of image forming" is defined by a number N of output transfer sheets S which is set to 10, for example. The controller 23 judges if these conditions are satisfied or not.

In the following processes, detection of the toner density adjustment pattern is performed at each time when the predetermined amount of image forming is made (e.g., when the number N (=10) of transfer sheets S or more are output after the image recording). However, in the following processes, the detection of the toner density adjustment pattern is not performed at power-on time. This is because, if the toner density adjustment is set to be conducted at a power-on time, a frequent switching of the main power would cause an event whereby a reference value of the toner density is varied to a relatively great extent regardless of whether an actual toner density is changed or not.

In contradistinction thereto, the charge voltage applied to the main-charge roller 2 is preferably controlled at power-on time. It is generally assumed that an apparatus will be unused for a day or a couple of days, for example, prior to power being applied thereto. That is, the mechanical parts would all be unused during the time before the power is turned on, and during which in many cases the environmental conditions around the apparatus would be changed. If the image forming apparatus 100 is utilized in this manner, then the main-charge roller 2 might not perform the charging operation in an appropriate manner. In such a case, the charge voltage adjustment and the half-tone voltage adjustment would be required to be performed.

When the above described conditions are satisfied and the check result of Step S01 is YES, the process proceeds to Step S02. In Step S02, for a predetermined time period, a charge output V which is the voltage applied to the main-charge roller 2 is reduced from a current value v by a predetermined value v1 and is applied to the main-charge roller 2 to charge the photoconductive member 1. Thereby, the charge voltage adjustment pattern is generated in a region corresponding to the above-mentioned predetermined time period on the photoconductive member 1. At the same time, the P sensor 16 is returned to an operable condition so that the image forming apparatus 100 is in a mode capable of performing a data sampling operation.

In Step S03, the controller 23 performs the toner density adjustment if the image forming apparatus 100 has completed a job defined by a predetermined amount, or a predetermined number, of image forming. More specifically, the controller 23 controls the light source LD to emit light at a maximum power. Furthermore, the above-mentioned region of the photoconductive member 1, which is charged by the main-charge roller 2 applied with the above described current charge output v, is exposed to the laser beam 20 including the light emitted by the LD at the maximum laser power and is developed by the development unit 3 in order that the toner density adjustment pattern is generated in a predetermined region.

Thus, on the photoconductive member 1, there are formed three regions: the background region charged with the current charge output v, the region of the charge voltage adjustment pattern charged with the reduced charge output (v–v1), and the region of the toner density adjustment pattern generated with the laser beam 20 based on the predetermined LD output at the maximum laser power on the region charged with the current charge output v. The background region has no deposition of the toner and appears to be white. The region of the charge voltage adjustment pattern is in a condition of being dusted with a small amount of the toner. The region of the toner density adjustment pattern appears to be a solid black region.

In Step S04, these three regions are detected by the P sensor 16. The P sensor 16 includes a pair of a light-emitting device and a photoreceptor, wherein the light-emitting device emits light and the photoreceptor receives light reflected from the light emitted by the light-emitting device, and converts the light into an electric signal which is output to the controller 23.

More specifically, in Step S4, the surface of the photoconductive member 1 is detected by the P sensor 16 at intervals of a time period predetermined based upon experimentation. Through this detection, detection outputs $V_{sg}$, $V_{sdp}$, and $V_{sp}$ of the P sensor 16 are obtained. The detection output $V_{sg}$ represents the background region charged with the current charge output. The detection output $V_{sdp}$ represents the region of the charge voltage adjustment pattern charged with the reduced charge output (v–v1). The detection output $V_{sp}$ represents the region of the toner density adjustment pattern. Moreover, in Step S04, the controller 23 calculates ratios of these values, such as $V_{sdp}/V_{sg}$ and $V_{sp}/V_{sg}$.

Subsequently, it is determined whether the ratio of $V_{sdp}/V_{sg}$ is within a predetermined range, and the charge voltage adjustment is performed. In Step S05, wherein the above predetermined range for the ratio of $V_{sdp}/V_{sg}$ is defined as to have a reference lower limit a, the controller 23 determines if the ratio of $V_{sdp}/V_{sg}$ is greater than the reference lower limit a. If the determination result of Step S05 is NO, it means that the charge voltage of the charge voltage adjustment pattern has been judged as being lower than the reference lower limit a. In this case, the process proceeds to Step S08 wherein the charge output is increased by a value such that the charge voltage of the charge voltage adjustment pattern has been judged as being higher than the reference lower limit a. Upon completing the increase of the charge output, the process proceeds to Step S09.

If the determination result of Step S05 is YES, this means that the charge voltage of the charge voltage adjustment pattern has been judged as being higher than the reference lower limit a. In this case, the process proceeds to Step S06, wherein the above predetermined range for the ratio of $V_{sdp}/V_{sg}$ is defined as having a reference upper limit b. In Step S06, the controller 23 determines if the ratio of $V_{sdp}/V_{sg}$ is greater than the reference upper limit b. If the determination result of Step S06 is YES, this means that the charge voltage of the charge voltage adjustment pattern has been judged as being higher than the reference lower value a and lower than the reference upper limit b. That is, the charge voltage of the charge voltage adjustment pattern is judged as being within the predetermined range. In this case, the process proceeds to Step S09.

If the determination result of Step S06 is NO, this means that the charge voltage of the charge voltage adjustment pattern has been judged as being higher than the reference upper limit b. In this case, the process proceeds to Step S07 wherein the charge output is decreased by a value such that the charge voltage of the charge voltage adjustment pattern is adjusted to a value which is lower than the reference upper limit b. Once the charge output has been decreased, the process proceeds to Step S09.

In Step S09, the controller 23 determines if the toner density adjustment pattern is generated in the upstream part of the process. As described above, the toner density adjustment is not performed before the completion of at least a job defined by a predetermined amount, or a predetermined number, of image forming. Therefore, if the image forming apparatus 100 has not completed at least a job defined by a predetermined amount, or a predetermined number, of image forming, the toner density adjustment pattern is determined as not being generated and the determination result of Step S09 is NO. In this case, the process proceeds to Step S14 from which the controller 23 starts the toner density adjustment operation.

If the image forming apparatus 100 has completed at least a job defined by a predetermined amount, or a predetermined number, of image forming, the toner density adjustment pattern is determined as being generated and the determination result of Step S09 is YES. In this case, the controller 23 determines if the ratio of $V_{sp}/V_{sg}$ is within a predetermined range, in Steps S10 and S11, so as to conduct the process along the flow of the toner density adjustment.

In Step S10, wherein the above predetermined range for the ratio of $V_{sp}/V_{sg}$ is defined as having a reference upper limit c, the controller 23 determines if the ratio of $V_{sp}/V_{sg}$ is smaller than the reference upper limit c. If the ratio of $V_{sp}/V_{sg}$ is not smaller than the reference upper limit c and the determination result of Step S10 is NO, it means that the toner density of the toner density adjustment pattern has been judged as being lower than a predetermined toner density reference value. That is, the toner density is too light. In this case, the process proceeds to Step S13 whereby the predetermined toner density reference value is increased by a predetermined value so that an amount of toner supply is increased. Upon completing the increase of the toner density reference value, the process proceeds to Step S14.

If the ratio of $V_{sp}/V_{sg}$ is smaller than the reference upper limit c and the determination result of Step S10 is YES, it means that the toner density of the toner density adjustment pattern has been judged as being at least within an allowable range relative to the upper limit c. In this case, the process proceeds to Step S11, wherein the above predetermined range for the ratio of $V_{sp}/V_{sg}$ is defined as having a reference lower limit d, and the controller 23 determines if the ratio of $V_{sp}/V_{sg}$ is greater than the reference lower limit d. If the ratio of $V_{sp}/V_{sg}$ is greater than the reference lower limit d and the determination result of Step S11 is YES, it means that the toner density of the toner density adjustment pattern has been judged as being at an allowable level relative both to the upper and lower limits c and d. In this case, the process proceeds to Step S14.

If the ratio of $V_{sp}/V_{sg}$ is not greater than the reference lower limit d and the determination result of Step S11 is NO, it means the toner density of the toner density adjustment pattern has been judged as being higher than the predetermined toner density reference value. That is, the toner density is dense. In this case, the process proceeds to Step S12 whereby the predetermined toner density reference value is decreased by a predetermined value so that an amount of toner supply is decreased. Upon completing the decrease of the predetermined toner density reference value, the process proceeds to Step S14.

In Step S14 et seq., the controller 23 performs the half-tone density adjustment. If the charge output is changed upstream of the flow such as in Step S7 or S8, the half-tone density is also changed. So, in Step S14, the controller 23 checks if the charge output is changed upstream of the flow such as in Step S07 or S08. In addition, in a case wherein a job is defined by a predetermined amount, or a predetermined number, of image forming and is executed during the previous execution of the half-tone density adjustment defined by an output of a number N' of transfer sheets S, which number N' is set to 1000, for example. If this number N' of the transfer sheets S or more are output during Step S14, the photoconductive member 1 may become deteriorated over time and the half-tone density may accordingly be varied. Therefore, in Step S14, the controller 23 also checks if the number N' of transfer sheets S or more are output.

Therefore, if the charge output is changed upstream of the flow or if the number N' of transfer sheets S or more are output and the check result of Step S14 is YES, the process proceeds to Step S15. In addition, if the charge output is changed upstream of the flow in Step S07 or S08, the process proceeds to Step S15, regardless of whether the image forming apparatus 100 has completed a job.

In Step S15, the toner density adjustment pattern is generated. In this case, the main-charge roller 2 is applied with the charge output changed in Step S7 or S8 so that the LD is driven to emit laser light at a predetermined power close to the maximum value and that a power wide modulation (PWM) of the laser light emission continues for a predetermined time period for the half-tone density adjustment. Then, the half-tone density adjustment pattern is generated in Step S15 with the laser beam 20 having pulses wherein each pulse has a light amount for one dot such that each dot of the half-tone adjustment pattern is made as a half-tone dot.

In Step S16, the half-tone density adjustment pattern is detected by the P sensor 16 which detection output is referred to as $V_{sm}$ and the controller 23 calculates a ratio of $V_{sm}/V_{sg}$, wherein the latter is previously detected by the P sensor 16.

Then, in Step S17 et seq., the controller 23 determines if $V_{sm}/V_{sg}$ is within a predetermined range and, if necessary, performs the adjustment for maintaining the half-tone density at a constant level, wherein the predetermined range has an upper limit e and a lower limit f.

In Step S17, the controller 23 checks if $V_{sm}/V_{sg}$ is smaller than the upper limit e. If $V_{sm}/V_{sg}$ is determined as not being smaller than the upper limit e and the check result of Step S17 is NO, it means that the detection output from the half-tone density adjustment pattern is greater than the reference value. Thus, the density of the half-tone density adjustment pattern is lower than the reference density. That is, the half-tone density is light. In this case, the light amount of the LD is increased by a predetermined amount in Step S20 so that the halftone density is determined as being lower than the upper limit e and higher than the lower limit f. But, if $V_{sm}/V_{sg}$ is determined as being smaller than the upper limit e and the check result of Step S17 is YES, the condition relative to the upper limit e is satisfied and the process proceeds to Step S18.

In Step S18, the controller 23 checks if $V_{sm}/V_{sg}$ is greater than the lower limit f. If $V_{sm}/V_{sg}$ is determined as being greater than the lower limit f and the check result of Step S18 is YES, the condition relative to the lower limit f is also satisfied and the process ends. But, if $V_{sm}/V_{sg}$ is determined as not being greater than the lower limit f and the check result of Step S18 is NO, it means that the detection output from the half-tone density adjustment pattern is smaller than the reference value. Thus, the density of the half-tone density adjustment pattern is higher than the reference density. That is, the half-tone density is dense. In this case, the light amount of the LD is decreased by a predetermined amount in Step S19 so that the half-tone density is determined as being lower than the upper limit e and higher than the lower limit f.

Upon completion of the above-mentioned half-tone density adjustment, the half-tone density adjustment may further be performed for other levels of half-tone so that a multi-level half-tone image can be obtained in a stable manner using an error diffusion method, for example.

This invention may be conveniently implemented using a conventional general purpose digital computer programmed according to the teaching of the present specification, as will be apparent to those skilled in the computer art. Appropriate software coding can readily be prepared by skilled programmers based on the teachings of the present disclosure, as will be apparent to those skilled in the software art. The present invention may also be implemented by the preparation of application specific integrated circuits or by interconnecting an appropriate network of conventional component circuits, as will be readily apparent to those skilled in the art.

Numerous additional modifications and variations of the present application are possible in light of the above teachings. It is therefore to be understood that within the scope of the appended claims, the present application may be practiced otherwise than as specifically described herein.

What is claimed as new and is desired to be secured by letters Patent of the United States is:

1. An image forming apparatus, comprising:

a photoconductive member;

a charging mechanism configured to charge a surface of said photoconductive member so that said surface is charged at a charge voltage;

an optical writing mechanism configured to write latent images including a first latent image and a second latent image on said surface of said photoconductive member charged at said charge voltage;

a development mechanism configured to develop said first latent image into a first toner pattern at a solid toner density and said second latent image into a second toner pattern at a half-tone toner density;

a sensing mechanism configured to detect reflection densities of said first and second toner patterns and to generate output signals representing detection results detected by said sensing mechanism; and a controlling mechanism configured to adjust values of said solid toner density, said charge voltage, and said half-tone toner density based on said output signals generated by said sensing mechanism, wherein said controlling mechanism adjusts said value of said charge voltage by changing a voltage to be applied to said charging mechanism at intervals of a predetermined time period and adjusts said value of said half-tone toner density based on said output signals generated by said sensing mechanism upon completing an adjustment of said solid toner density by controlling said optical writing mechanism to change a light amount.

2. An image forming apparatus as defined by claim 1, wherein said charging mechanism includes a charging roller configured to apply a charge to said photoconductive member in contact thereto.

3. An image forming apparatus as defined by claim 1, wherein said optical writing mechanism writes a third latent image on said surface of said photoconductive member charged at said charge voltage and said development mechanism develops said third latent image into a third toner pattern at a solid toner density in order that said first toner pattern is used to adjust said value of said solid toner density and said third toner pattern is used to adjust the value of said charge voltage.

4. An image forming apparatus as defined in claim 1, wherein said controlling mechanism adjusts said value of said charge voltage based on said output signals generated by said sensing mechanism after a completion of a job.

5. An image forming apparatus as defined by claim 1, wherein said controlling mechanism adjusts said value of said half-tone toner density by controlling said optical writing mechanism to change said light amount at multiple levels in order that said apparatus forms a multi-level half-tone image.

6. An image forming apparatus as defined by claim 5, wherein said multi-level half-tone image is formed using an error diffusion.

7. An image forming apparatus, comprising:

photoconductive member means;

charging means for charging a surface of said photoconductive member means so that said surface is charged at a charge voltage;

optical writing means for writing latent images including a first latent image and a second latent image on said surface of said photoconductive member means charged at said charge voltage;

development means for developing said first latent image into a first toner pattern at a solid toner density and said second latent image into a second toner pattern at a half-tone toner density;

sensing means for detecting reflection densities of said first and second toner patterns and to generate output signals representing detection results detected by said sensing means; and controlling means for adjusting values of said solid toner density, said charge voltage, and said half-tone toner density based on said output signals generated by said sensing means, wherein said controlling means adjusts said value of said charge voltage by changing a voltage to be applied to said charging means at intervals of a predetermined time period and adjusts said value of said half-tone toner density based on said output signals generated by said sensing means upon completing an adjustment of said solid toner density by controlling said optical writing means to change a light amount.

8. An image forming apparatus as defined by claim 7, wherein said charging means includes a charging roller configured to apply a charge to said photoconductive member means in contact thereto.

9. An image forming apparatus as defined by claim 7, wherein said optical writing means writes a third latent image on said surface of said photoconductive member means charged at said charge voltage and said development means develops said third latent image into a third toner pattern at a solid toner density in order that said first toner pattern is used to adjust said value of said solid toner density and said third toner pattern is used to adjust the value of said charge voltage.

10. An image forming apparatus as defined in claim 7, wherein said controlling means adjusts said value of said charge voltage based on said output signals generated by said sensing means after a completion of a job.

11. An image forming apparatus as defined by claim 7, wherein said controlling means adjusts said value of said half-tone toner density by controlling said optical writing means to change said light amount at multiple levels in order that said apparatus forms a multi-level half-tone image.

12. An image forming apparatus as defined by claim 5, wherein said multi-level half-tone image is formed using an error diffusion.

13. A method of image density adjustment, comprising the steps of:

charging a surface of a photoconductive member so that said surface is charged at a charge voltage;

optically writing latent images including a first latent image and a second latent image on said surface of said photoconductive member charged at said charge voltage;

developing said first latent image into a first toner pattern at a solid toner density and said second latent image into a second toner pattern at a half-tone toner density;

detecting reflection densities of said first and second toner patterns;

generating output signals representing results of said detecting step; and adjusting values of said solid toner density, said charge voltage, and said half-tone toner density based on said output signals generated by said generating step, wherein said adjusting step adjusts said value of said charge voltage by changing a voltage to be applied in said charging step at intervals of a predetermined time period and said value of said half-tone toner density based on said output signals upon completing an adjustment of said solid toner density by controlling said optically writing step to change a light amount.

14. A method of image density adjustment as defined by claim 13, wherein said charging step includes using a charging roller configured to apply a charge to said photoconductive member in contact thereto.

15. A method of image density adjustment as defined by claim 13, wherein said optically writing step includes writing a third latent image on said surface of said photoconductive member charged at said charge voltage and said development step includes developing said third latent image into a third toner pattern at a solid toner density in order that said first toner pattern is used to adjust said value of said solid toner density and said third toner pattern is used to adjust the value of said charge voltage.

16. A method of image density adjustment as defined in claim 13, wherein said adjusting step adjusts said value of said charge voltage based on said output signals generated in said generating step after a completion of a job.

17. A method of image density adjustment as defined by claim 13, wherein said adjusting step includes adjusting said value of said half-tone toner density by controlling said optically writing step to change said light amount at multiple levels in order that said adjustment is applied to a multi-level half-tone image.

18. A method of image density adjustment as defined in claim 17, wherein said multi-level half-tone image is formed using an error diffusion.

19. A computer readable medium containing program instructions for execution on a computer, which when executed by the computer, cause the computer to perform the functions of the controlling mechanism defined by any one of claims 1 to 6.

* * * * *